US006867747B2

(12) United States Patent
Price et al.

(10) Patent No.: US 6,867,747 B2
(45) Date of Patent: Mar. 15, 2005

(54) HELICAL ANTENNA SYSTEM

(75) Inventors: Edward G. Price, Sandy, UT (US); Richard F. Gordon, Salt Lake City, UT (US)

(73) Assignee: Skywire Broadband, Inc., Salt Lake City, UT (US)

( * ) Notice: Subject to any disclaimer, the term of this patent is extended or adjusted under 35 U.S.C. 154(b) by 66 days.

(21) Appl. No.: 10/056,924

(22) Filed: Jan. 25, 2002

(65) Prior Publication Data

US 2003/0156072 A1 Aug. 21, 2003

Related U.S. Application Data

(60) Provisional application No. 60/264,174, filed on Jan. 25, 2001.

(51) Int. Cl.[7] ..... H01Q 1/36
(52) U.S. Cl. ..... 343/895
(58) Field of Search ..... 343/860, 872, 343/895

(56) References Cited

U.S. PATENT DOCUMENTS 4,161,737 A * 7/1979 Albright ..... 343/895
5,479,182 A * 12/1995 Sydor ..... 343/895
5,635,945 A * 6/1997 McConnell et al. ..... 343/895
5,678,201 A * 10/1997 Thill ..... 455/575
5,838,285 A * 11/1998 Tay et al. ..... 343/895
5,854,608 A 12/1998 Leisten
6,011,524 A 1/2000 Jervis
6,034,650 A 3/2000 Kuramoto
6,064,346 A 5/2000 Blom
6,075,501 A 6/2000 Kuramoto et al.
6,133,891 A 10/2000 Josypenko
6,150,994 A 11/2000 Winter et al.
6,181,296 B1 * 1/2001 Kulisan et al. ..... 343/895
6,292,156 B1 * 9/2001 Openlander ..... 343/895
6,373,448 B1 * 4/2002 Chun ..... 343/895

* cited by examiner

*Primary Examiner*—Tho Phan
(74) *Attorney, Agent, or Firm*—Thorpe North & Western, LLP

(57) ABSTRACT

The invention provides a helical antenna to broadcast a signal from an input line. The antenna includes a base plate and a dielectric rod mounted on the base plate. A conductive helix, surrounds the dielectric rod, and the rod has a pitch angle of at least 12 degrees. A matching network is connected to the conductive helix, to match an impedance of the conductive helix with an impedance of the signal.

15 Claims, 8 Drawing Sheets

END VIEW

HELICAL ANTENNA SYSTEM

This application claims the benefit of U.S. Provisional Application No. 60/264,174 filed on Jan. 25, 2001.

TECHNICAL FIELD

The present invention relates generally to a helical antenna system. More particularly, the present invention relates to a helical antenna that has an increased broadcast capability and power efficiency.

BACKGROUND ART

Telecommunications and data transmission have become increasingly important for our modern society. One very important method of transmitting data has been through the air using a transmitter and a receiver. Both the transmitter and the receiver use an antenna to transmit or receive a signal. Accordingly, there have been many forms of antennas devised to increase the power and directivity of signal transmission and reception.

More recently, antennas have been used to transmit and receive very directional signals that carry digital information. For example, microwave dishes are used in the communications industry to carry telephone messages and other information over long ranges. Internet connections are also being provided using directional broadband equipment, which transmits data to and receives information from subscribers.

Because of the advent of computer networking it is important to be able to send directional data over shorter distances with lower power. Unfortunately, directional antennas such as microwave and satellite antennas are generally too expensive to use for short range, low power signal transmissions. Of course, other types of straight or looped antennas can be used for these short-range transmissions but these configurations often suffer from interference and attenuation when they are transmitting a low power signal.

SUMMARY OF THE INVENTION

The invention provides a helical antenna to broadcast a signal from an input line. The antenna includes a base plate and a dielectric rod mounted on the base plate. A conductive helix surrounds the dielectric rod, and the rod has a pitch angle of at least 12 degrees. A matching network is connected to the conductive helix, to match an impedance of the conductive helix with an impedance of the signal. The dielectric rod can be nylon, acetal resin, or a Delrin rod. In addition the base plate can include a conductive surface. A resonant center rod can also be included to enhance the signal transmission.

In accordance with one aspect of the present invention, the system includes a tapered strip line matching network, connected to the conductive helix to match the impedance of the conductive helix with the impedance of an input line. The tapered strip line matching network can also be a crescent shaped strip line that conforms to the circumference of the dielectric rod along the length of the strip line.

Additional features and advantages of the invention will be set forth in the detailed description which follows, taken in conjunction with the accompanying drawings, which together illustrate by way of example, the features of the invention.

DETAILED DESCRIPTION

Figure 1:
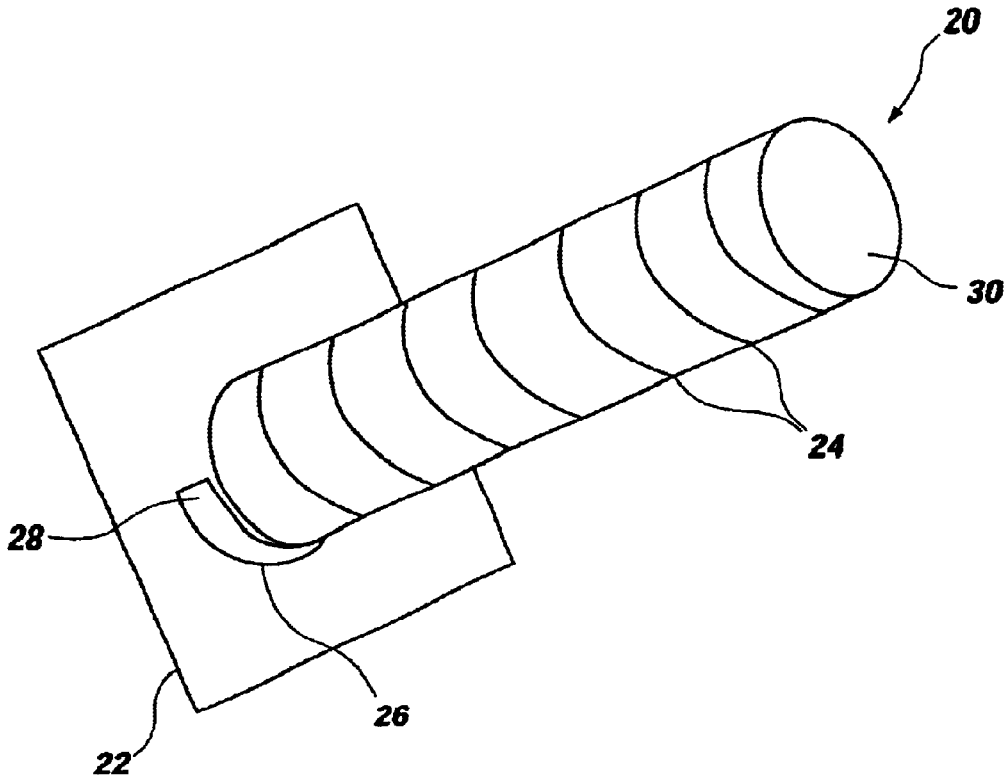
FIG. 1 depicts a perspective view of a helical antenna mounted on a backplane or base plate with an impedance matching network.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 12:
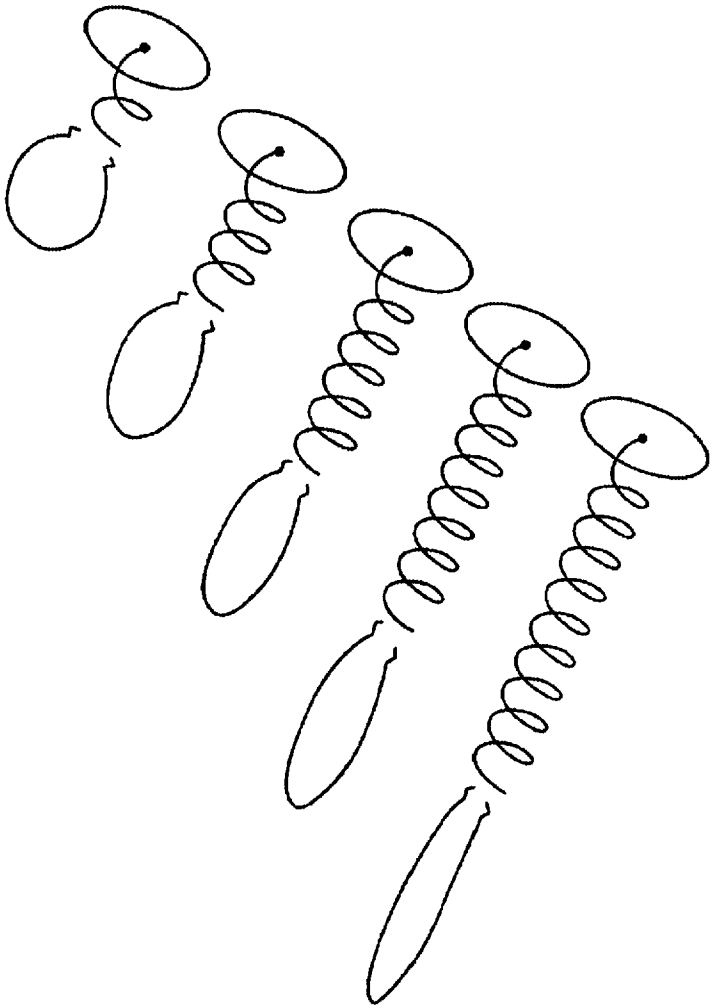
FIG. 12 (PRIOR ART)
FIG. 12 shows the beam pattern generated by helical networks with 2 to 10 turns.

One important form of an antenna is a helical antenna, which is well known to those skilled in the art. The helical antenna can be arranged in many configurations, but one particular helix configuration uses approximately the same circumference length for the turns of the helix as the wavelength the antenna will transmit. In this case, the helix transmits a well-defined beam that is called "axial or beam mode radiation". FIG. 12 illustrates the effect of the number of turns in the helix on measured field patterns. As the number of turns increases, the beam of propagated radiation becomes more focused.

Figure 13:
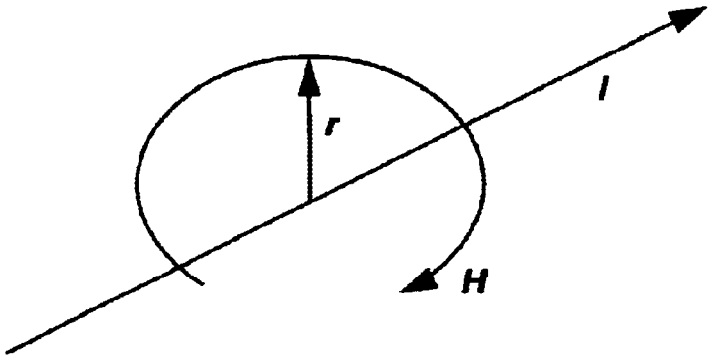
FIG. 13 (PRIOR ART)
FIG. 13 depicts the magnetic flux at radius r generated by a current flowing through wire.
Figure 14:
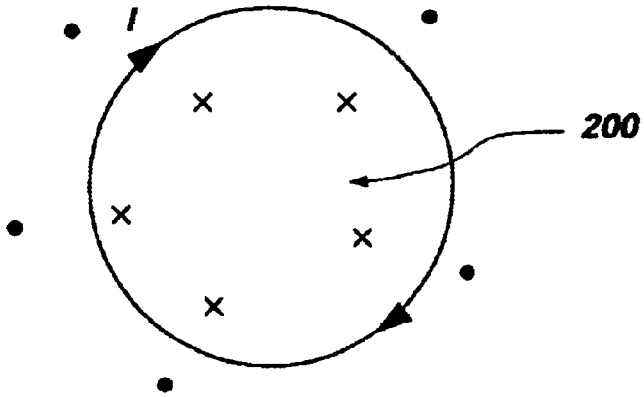
FIG. 14 (PRIOR ART)
FIG. 14 illustrates an end view of a helical antenna and the flux lines generated by the antenna.

FIGS. 13 and 14 help illustrate the reason an axial field pattern is generated. FIG. 13 illustrates the magnetic flux resulting from an alternating current in a conductor. A flux line H will exist in a 90-degree plane with respect to current vector I. The flux lines decrease in magnitude in proportion to the distance r.

FIG. 14 illustrates an end view of a helical antenna. The current carrying conductor in a helix is formed into a circle and is wound in helix form with a winding pitch angle of 12–13 degrees. Furthermore, when the circumference of each turn is on the order of one wavelength, then the resulting flux concentration appears as illustrated in FIG. 14. The flux in the center of the region 200 is added together to reinforce the flux inside the helix. The flux on the outside region of the helix is cancelled. The traveling wave in the helix contributes outer flux lines that combine with near flux lines and result in cancellation.

FIG. 1 depicts a perspective view of a helical antenna 20. The helical antenna is configured to broadcast a signal from an input line (not shown). A base plate 22 or backplane supports a conductive helix 24. The conductive helix has a pitch angle of at least 12 degrees or greater, but the pitch angle is preferably 13 degrees. A matching network 26 to match an impedance of the conductive helix with an impedance of the input line is also provided. A dielectric rod 30 may also be mounted on the base plate to support the helix. In this embodiment, the helix is mounted onto the dielectric rod or in a groove that is machined into the dielectric rod. The properties of the dielectric rod will be discussed later.

The matching network 26 consists o a quarter-wave long section of transmission strip. The one quarter-wavelength distance is determined in relation to the center of a selected frequency band. In one embodiment, this strip line couples the center conductor of the source connector coaxial line 28, which has an impedance of 50 ohms, to the helix 24, which has an impedance of 150 ohms. The matching network can function over the operating frequency band 2400 to 2500 MHz (2.4–2.5 GHz). This frequency is significant because it falls in an unlicensed frequency band that is restricted to low power transmissions. Using the correct impedance matching assists a low power transmission because otherwise the transmitted signal strength is affected when power is lost. The length of a matching network will vary based on the frequency being transmitted. This antenna can transmit frequencies outside the band discussed here and the matching network can be sized accordingly.

Figure 2:
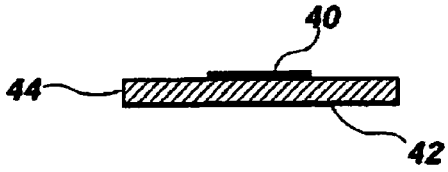
FIG. 2 illustrates a cross sectional view of a strip line impedance matching network.

FIG. 2 illustrates a cross sectional view of a strip line impedance matching network. The impedance matching network is a conductor 40, which is placed parallel to a second conductor 42. The second conductor may be the backplane or base plate. The conductors can be made of copper, aluminum, gold or some other conductive material. Separating the two conductors is a dielectric material such as air, plastic or some other material with a relative permittivity $\in_r$.

Figure 3:
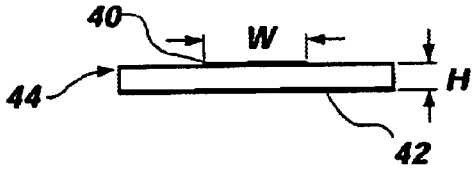
FIG. 3 illustrates a cross sectional view of the dimensions that can be used to calculate the required impedance of a strip line.

The requirements of the impedance match are such that a constant and flat coupling within a voltage standing wave ratio maximum of 1.2/1 is desirable over the preferred bandwidth. To accomplish this matching characteristic, the physical design provides a strip width versus strip height above the antenna base plate according to the following formula.

$$H=W/[(377/Z_O\sqrt{\in_r})-2]$$

Where $Z_O$ is the characteristic impedance of the transmission line at the selected location (e.g., the impedance of a coaxial input line). Referring now to FIG. 3 for one example embodiment of the antenna, W=10 mm, source coaxial line impedance $Z_O$ is 50 ohms, space dielectric constant $\in_r=1$, and the height H results in 1.8 mm.

Figure 4:
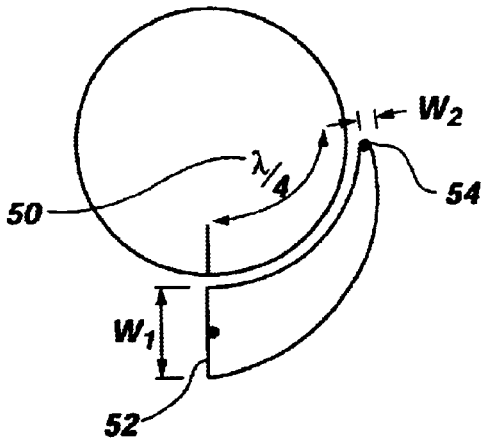
FIG. 4 depicts a top view of a crescent shaped impedance matching network used with a helical antenna.

As illustrated in FIG. 4, the tapered network proceeds through one-quarter wavelength 50, relating to the nominal frequency band that is desired. The width $W_1$ 52 tapers uniformly in a circular fashion along the periphery of the helix body, as shown, terminating at and equal to the width $W_2$ 54 of the magnet wire conductor of the helix. Using this type of matching frequency can provide a 94% to 99% efficient antenna because it reduces a reflected transmission loss in the antenna. Moreover, this matching network provides a very flat transmission response over a wide spectrum of frequencies. This is in contrast to most antennas which experience a sharp drop off in transmitted power for certain frequencies.

Figure 5:
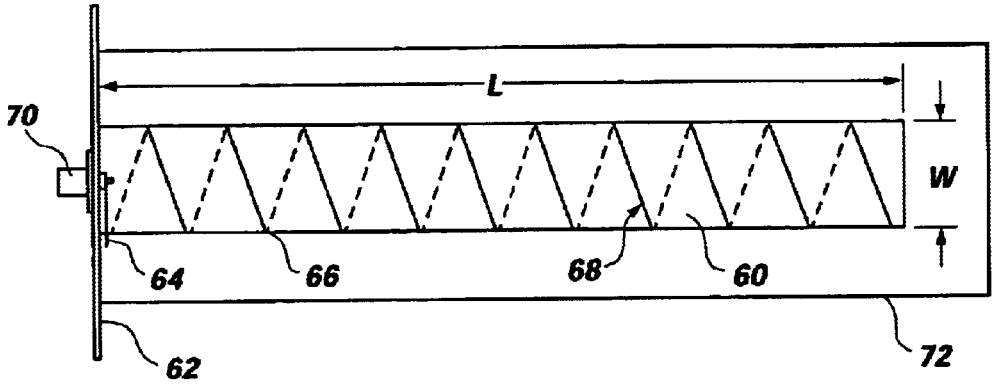
FIG. 5 illustrates a side view of a helical antenna.

FIG. 5 illustrates a side view of a helical antenna. A dielectric rod 60 is mounted on a conductive base 62. The helical antenna 66 is attached to the support rod at a selected angle 68 and the signal input 70 is connected to the helical antenna through the matching network 64. The number of turns used in the conductive helix is found to be specifically effective if either 5, 10 or 15 turns are used. Of course, a specific number of turns is not required.

The dielectric rod as depicted is formed from an acrylic, nylon, acetal resin, Delrin, plastic, or some other dielectric material. The preferred dielectric in this application is a low loss plastic material known as Delrin®, which is an acetal resin manufactured by Dupont Corporation having the following basic characteristics.

Dielectric constant $\in_r=3.5$ (at 2500 MHz)

Volume resistivity$=1\times10^{14}$

One purpose of the dielectric rod is to provide a support for the helix conductor. The electrical function of the rod is to concentrate the electromagnetic radiation of the helix in its interior region. Also, the electrical size of the helix is increased by the square root of the dielectric constant, $\sqrt{3.5}$, or 1.87. In other words, the helix operates electromagnetically as though it is almost two times larger than it actually is, as a result of the dielectric rod. Because of the concentrating effect of the dielectric material, the directivity of the helical antenna is increased. Further, because of the excellent volume resistivity of the dielectric material, the efficiency of the helix radiator is maintained near its theoretical limit.

Another useful dielectric that can be used for the rod is acrylic. Other low loss dielectrics can be used inside the helix, if desired. The use of a dielectric cover over the helical antenna 72 (FIG. 5) increases the axial transmission range of the antenna. A cover that is at least two inches in diameter has been found to further focus the antenna's transmission effectiveness. One preferred cover diameter is a three-inch cover, which is generally cylindrical in shape.

Figure 6:
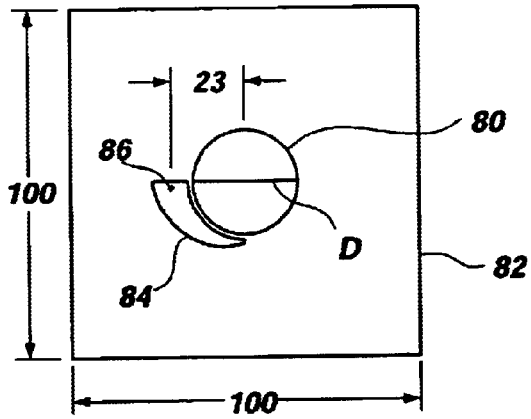
FIG. 6 depicts a top view of a helical antenna and impedance matching network mounted on the top of a backplane.

FIG. 6 illustrates a top view of the antenna without a cover. The dielectric rod 80 is attached to a base 82. One embodiment of the invention includes a dielectric rod with a 230-millimeter length and a 31.8-millimeter diameter D. In addition, the measurement between the rod center and the signal input connector 86 can be 23 millimeters. The dimensions of the base can be 100 millimeters square. The matching network 84 will be the length of one quarter of a wavelength.

Figure 7:
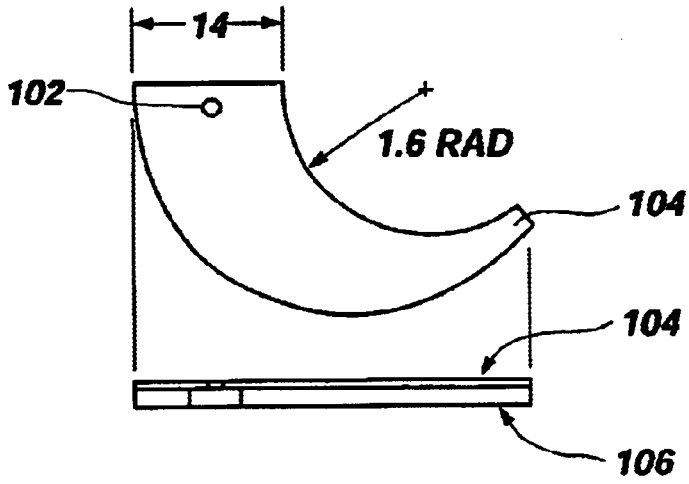
FIG. 7 illustrates an orthogonal top view correlated with a side view of a crescent shaped impedance matching network for a helical antenna.
Figure 8:
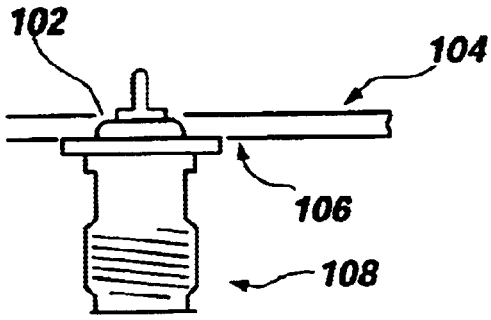
FIG. 8 is a partial cross section side view of a connector that connects the impedance matching network to the backplane.

FIGS. 7 and 8 illustrate a more detailed side and top view of the impedance matching network. The crescent shaped matching network 104 in FIG. 7 has hole or connection point 102 for the input line. The matching network can start out at 14 millimeters or roughly one radius of the helix and then taper down to the size of the wire used in the helical antenna. As mentioned the matching network is preferably made of copper and is mounted on a printed circuit board or plastic base 106 that includes an opposing conductive surface. FIG. 8 illustrates the impedance matching network from the side view and further includes the signal input connector 108. It will be auparent from FIG. 8 that the input connector 108 electrically interconnects the shielding of the input coaxial line to the conductive base plate, so as to provide the conditions for impedance matching. It is the electromagnetic interaction of the matching network and the base plate that matches the impedance. The base plate thus forms an extension of the shielding of the input line. The base plate also serves as a back plane or reflector that helps form the desired electromagnetic waveform broadcast by the antenna.

Figure 9:
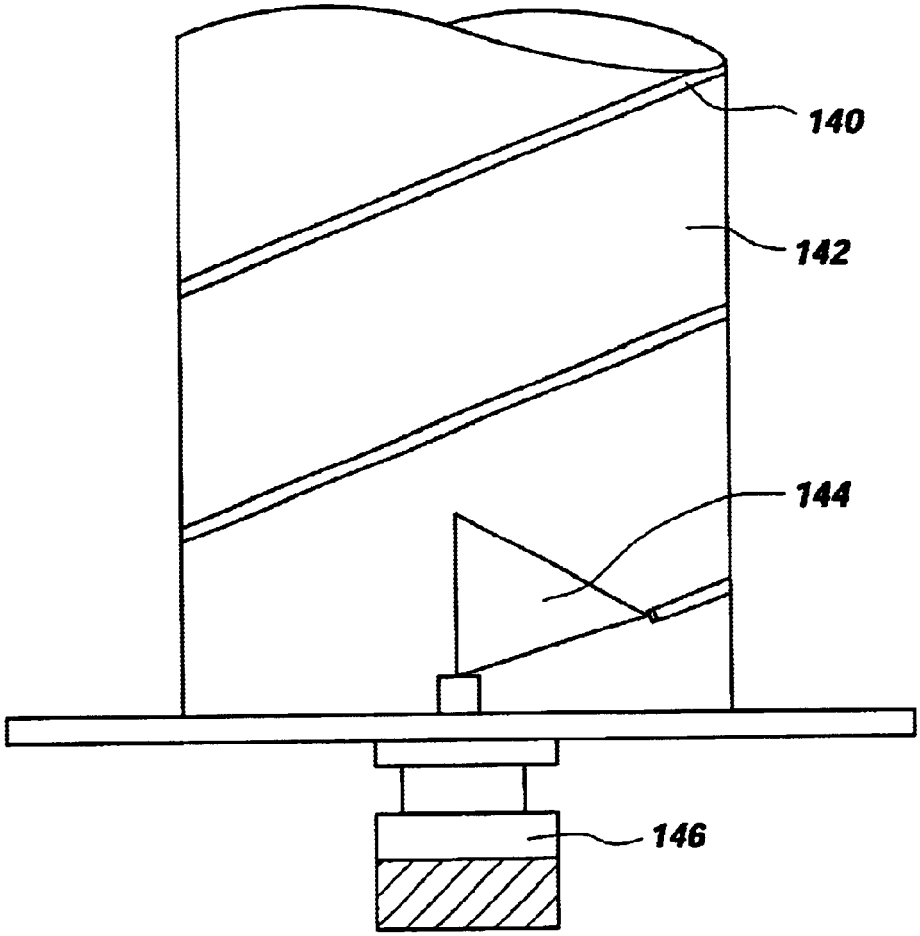
FIG. 9 illustrates a triangular shaped impedance matching network that is mounted perpendicularly with respect to the base plate.

FIG. 9 illustrates a triangular shaped impedance matching network that is mounted perpendicularly with respect to the base plate. The helical antenna includes a wire 140 wrapped around a support rod 142 made of nylon or plastic. A flat triangular shaped matching network 144 is used to match the impedance of the input line 146 to the antenna. The triangular matching network shown in FIG. 9 can also be curved to conform to the support rod.

Figure 10:
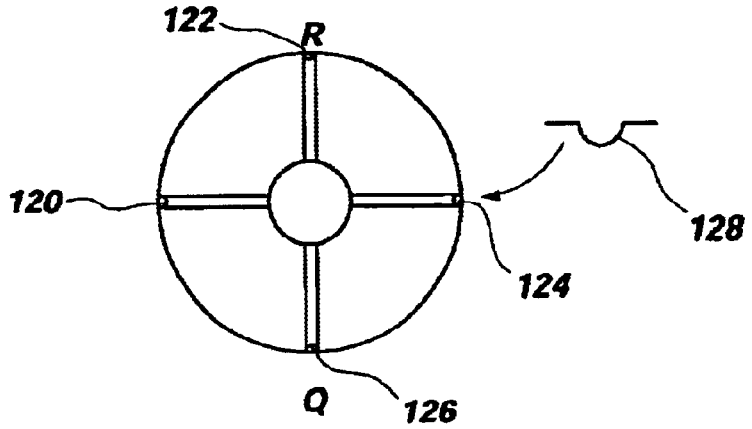
FIG. 10 illustrates an end view of a quadrafiler helical antenna.
Figure 11:
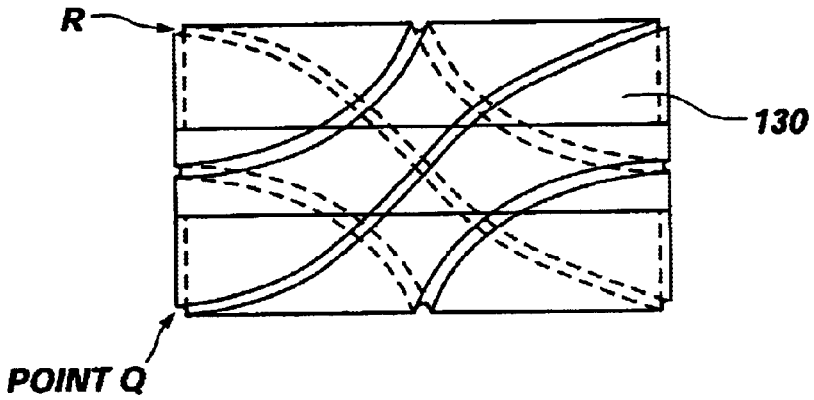
FIG. 11 illustrates a side view of a quadrafiler helical antenna of FIG. 9.

An alternative embodiment of the invention is a quadrafiler antenna that includes a quadrafiler helix, which radiates a cardiod shaped circularly polarized pattern. This antenna, as depicted in FIGS. 10 and 11, is a high gain device. The quadrafiler is also effective with broadband transmissions. FIG. 10 illustrates that the antenna consists of four wire conductor helices 122, 124, 126, 128 equally spaced circumferentially on a cylinder in grooves 128 and fed with equal amplitude signals with relative phases of 0, 90, 180 and 270 degrees. In FIG. 11, the support rod 130 for the quadrafiler antenna is formed of nylon, acetal resin or Delrin that provides similar electrical and mechanical features as disclosed for the helical antenna; FIGS. 9 and 10 include the reference points Q and R to show how the bottom and side views are related.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A directional antenna configured to broadcast a signal from an input line having a core and shielding, comprising:

a) a conductive base plate, operatively interconnected to the shielding of the input line;

b) a substantially solid, cylindrical dielectric rod, mounted on the base plate;

c) a single, unidirectional conductive helix, wrapped around an outer surface of the dielectric rod, having a pitch angle of at least 12 degrees; and d) a strip line matching network, attached between the core of the input line and the conductive helix, which tapers from a maximum width at a connection point on the input line to a minimum width at a connection point with the conductive helix, wherein the matching network is configured to match an impedance of the conductive helix with an impedance of the input line.

2. A directional antenna as in claim 1, wherein a length of the strip line matching network is ¼ of signal wavelength.

3. A directional antenna as in claim 1, wherein a side of the strip line matching network conforms to the shape of a curved side of the dielectric rod.

4. A directional antenna as in claim 1, wherein the strip line matching network conforms to the shape of a curved side of the dielectric rod, and forms a triangularly shaped matching network.

5. A directional antenna as in claim 1, wherein a side of the strip line matching network conforms to the shape of a curved side of the dielectric rod, and forms a crescent shaped matching network.

6. A directional antenna as in claim 1, wherein the strip line matching network tapers along a linear axis to form a matching network.

7. A directional antenna as in claim 1, wherein the strip line matching network tapers from a maximum width of approximately one radius of the dielectric rod to a minimum width approximately equal to a diameter of wire forming the helix.

8. A directional antenna as in claim 1, wherein the matching network is substantially parallel to the base plate.

9. A directional antenna as in claim 1, wherein the matching network is configured to match a higher impedance of the conductive helix with a lower impedance of the input line.

10. A directional antenna as in claim 1, wherein the dielectric rod is of materials selected from the group consisting of acetal resin, acrylic, and nylon.

11. A directional antenna as in claim 10, wherein the acetal resin dielectric rod is Delrin.

12. A directional antenna as in claim 1, further comprising a plastic layer between the conductive base plate and the matching network.

13. A directional antenna as in claim 1, further comprising a dielectric enclosure attached to the base plate and enclosing the dielectric rod, the conductive helix, and the matching network, wherein the dielectric enclosure enhances an output of the helical antenna.

14. A directional antenna as in claim 1, wherein the strip line matching network provides a substantially flat transmission response over a spectrum of frequencies.

15. A directional antenna as in claim 1, wherein the number of turns of the conductive helix is selected from the group consisting of 5, 10 and 15 turns.

* * * * *